US007219896B2

(12) United States Patent
MacIver et al.

(10) Patent No.: US 7,219,896 B2
(45) Date of Patent: May 22, 2007

(54) SPELLING GAMES

(75) Inventors: Peter MacIver, Huntington Beach, CA (US); Arron Mack, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 136 days.

(21) Appl. No.: 11/025,819

(22) Filed: Dec. 28, 2004

(65) Prior Publication Data

US 2005/0167917 A1 Aug. 4, 2005

Related U.S. Application Data

(60) Provisional application No. 60/533,992, filed on Jan. 2, 2004.

(51) Int. Cl.
*A63F 3/06* (2006.01)

(52) U.S. Cl. ..... 273/269; 273/272; 273/296; 273/299; 273/302; 273/308; 273/141 R; 434/167; 434/170; 434/172

(58) Field of Classification Search ..... 273/269, 273/272, 296, 299, 302, 308, 141 R, 142 A–142 G, 273/142 J, 142 JA–142 JD, 142 R, 144 R, 273/144 A, 144 B; 434/167, 170, 171, 172
See application file for complete search history.

(56) References Cited

U.S. PATENT DOCUMENTS

| | | | | |
|---|---|---|---|---|
| 155,131 | A | 9/1874 | West | |
| 1,085,405 | A | 1/1914 | Dadd | |
| 1,162,629 | A | 11/1915 | Mager | |
| 1,203,473 | A | 10/1916 | Branch | |
| 1,312,278 | A | 8/1919 | Shinn | |
| 1,399,811 | A | 12/1921 | Smith | |
| 1,512,147 | A | 10/1924 | Tegtmeyer et al. | |
| 2,199,499 | A | 5/1940 | Kreitler | |
| 2,444,768 | A * | 7/1948 | Eby | 434/159 |
| 2,585,463 | A | 2/1952 | Horine | |
| 3,413,004 | A * | 11/1968 | Smith | 273/269 |

(Continued)

FOREIGN PATENT DOCUMENTS

| | | |
|---|---|---|
| EP | 0350592 | 1/1990 |

(Continued)

OTHER PUBLICATIONS

Elmo's ABC Cereal Game, Mattel/Fisher-Price toy # 68876, Rule Sheet (2 pages).

*Primary Examiner*—Benjamin Layno
(74) *Attorney, Agent, or Firm*—Kolisch Hartwell, P.C.

(57) ABSTRACT

Games for at least one player may include at least one game card, each game card including a plurality of letter indicators each indicating a letter and arranged to spell a word, a plurality of letter tokens, each letter token including a letter indicator, a selection device operable to randomly indicate one of a plurality of groups of two or more letter indicators, and a set of rules to play the game. Methods of playing the game may include spelling a word on a selected game card by matching letter tokens to the letter indicators on the game card. Each game card may include a first side and a second side, each side including a word, such that the word on the first side is more difficult to spell than the word on the second side.

15 Claims, 2 Drawing Sheets

U.S. PATENT DOCUMENTS

| | | | | | |
|---|---|---|---|---|---|
| 3,495,701 | A | * | 2/1970 | Chandos | 273/272 |
| 3,665,618 | A | | 5/1972 | Hahn | |
| 3,715,812 | A | * | 2/1973 | Novak | 434/170 |
| 3,845,958 | A | | 11/1974 | Reinertsen | |
| 4,344,626 | A | | 8/1982 | Wadland | |
| 4,592,553 | A | | 6/1986 | Mammen et al. | |
| 4,690,409 | A | * | 9/1987 | Scalia | 273/299 |
| 4,715,608 | A | | 12/1987 | Burt | |
| 4,973,058 | A | * | 11/1990 | Breen | 273/240 |
| 5,167,503 | A | | 12/1992 | Jordan | |
| 5,316,482 | A | | 5/1994 | Bryson | |
| 5,362,061 | A | | 11/1994 | Napolitano | |
| 5,507,495 | A | | 4/1996 | Kiss | |
| 5,520,394 | A | * | 5/1996 | Brueckner | 273/272 |
| 2003/0038424 | A1 | | 2/2003 | Kummer | |

FOREIGN PATENT DOCUMENTS

| | | |
|---|---|---|
| FR | 2561118 | 9/1985 |
| GB | 2071505 | 9/1981 |
| GB | 2087736 | 6/1982 |
| GB | 2091112 | 7/1982 |
| GB | 2108051 | 5/1983 |
| GB | 2117255 | 10/1983 |
| GB | 2125301 | 3/1984 |
| GB | 2035101 | 6/1990 |
| GB | 2227182 | 7/1990 |

* cited by examiner

SPELLING GAMES

RELATED APPLICATIONS

This application is based upon and claims priority under 35 U.S.C. § 119(e) to the U.S. Provisional Patent Application No. 60/533,992, entitled "Letter Soup Game" and filed on Jan. 2, 2004, the disclosure of which is incorporated herein by reference in its entirety for all purposes.

TECHNICAL FIELD

The present disclosure relates generally to spelling games, and more specifically to rules and game components for playing spelling games in which one or more players each attempt to spell a word or words on a selected game card by matching letter tokens, each of which includes a letter indicator, with the letters in the spelled word (or words) on the game card, by using a selection device such as a spinner.

BACKGROUND

Examples of spelling games using letter chips or tiles and game cards include "Elmo's ABC Cereal Game" (Mattel/Fisher-Price), and also can be found in the disclosures of U.S. Pat. Nos. 1,085,405, 1,162,629, 1,312,278, 1,399,811, 1,512,147, 2,585,463, 3,845,958, 4,592,553, 4,715,608, and UK Patent Application No. GB2117255A. The disclosures of the aforementioned references are incorporated herein by reference in their entirety for all purposes.

SUMMARY

The present disclosure provides rules and game components for playing spelling and/or letter recognition games, which may be used, for example, as an instructional aid to assist young players in developing reading, spelling, and/or letter recognition skills. Game components may include letter tokens, each of which further includes a letter indicator, and game cards, each of which further includes several letter indicators arranged to spell a word. Optionally, some embodiments may further include a selection device such as a spinner, which may be operable to randomly indicate one of several groups of letter indicators.

In such embodiments, each player may attempt to "spell" the word on a selected game card by matching letter indicators on letter tokens with the letter indicators on the game card. The spinner may be used in such embodiments, for example, to allow a player to determine if a group of letter indicators indicated by the spinner includes any letters in the spelled word on the player's game card. If it does, the player may choose a letter token with the corresponding letter indicator and place it on the game card.

In some embodiments, each letter indicator on the various game apparatus may include distinguishable secondary recognition indicia corresponding to the letter indicated. For example, each letter may correspond with a different color. Such secondary recognition indicia may assist players to recognize, and/or distinguish among, different letters. Optionally, game cards may include a graphical representation of the spelled word, such as an illustration or a photograph.

Sets of rules for playing games using the described components may provide that players take alternating turns, or rounds, to attempt to spell words on selected cards. In an exemplary set of rules, a round or player's turn may include spinning the spinner to randomly indicate a group of letter indicators, determining whether any of the letter indicators in the indicated group are included in the spelled word on the game card, choosing a letter token having a letter indicator that is included in both the indicated group and the spelled word, and placing the chosen letter token on the letter indicator on the game card that corresponds with the letter indicator on the chosen letter token.

The game components and/or rules may be adapted to accommodate players of different skill levels, and/or to present a more challenging aspect to players as they develop spelling and/or letter recognition skills. For example, some embodiments may include two-sided game cards, each side including a spelled word. The two spelled words on the opposite sides may differ in one or more manners, such as the word on one side being longer than the spelled word on the other side, the spelled word being the same on both sides but spelled with color-coded letter indicators on only one side, and so forth.

Optionally, some embodiments of the game may be based on a theme, such as to enhance entertainment value of the game and/or provide a context within which players may more easily understand the rules of game play. For example, an exemplary embodiment may be based on the theme of spelling words with the letter-shaped noodles in bowls of alphabet soup.

DETAILED DESCRIPTION

Figure 1:
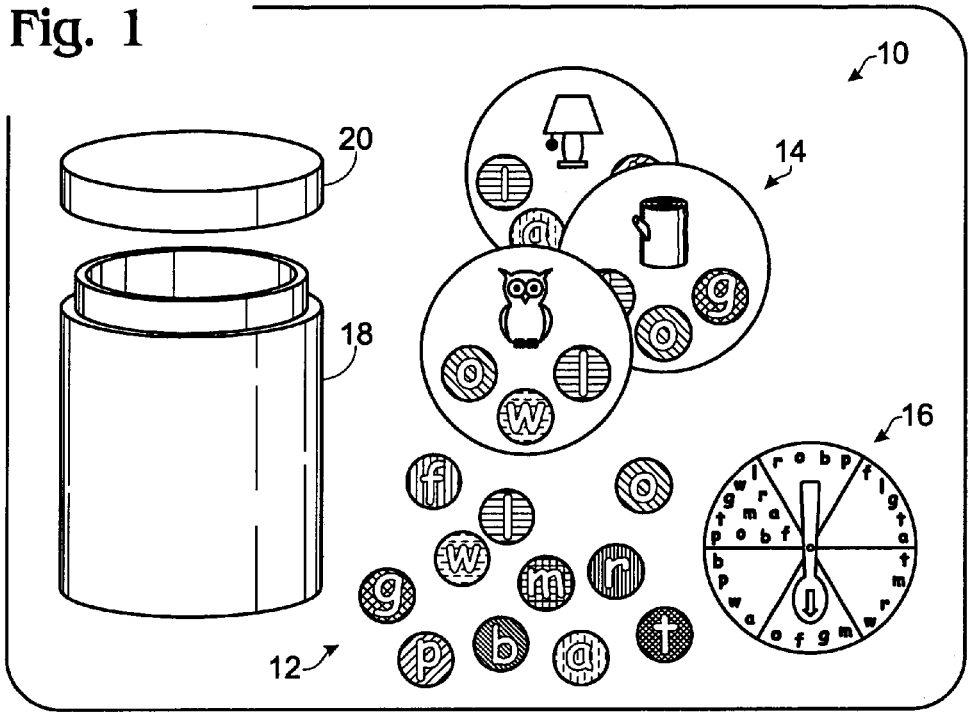
FIG. 1 depicts exemplary game components suitable for use with games of the present disclosure, including letter tokens, game cards, a spinner, and a game container.

Exemplary embodiments of game components and rules for game play are described herein with reference to FIGS. 1-8. Referring first to FIG. 1, a game 10 may include a plurality of letter tokens 12, a plurality of game cards 14, a spinner 16, and a storage container 18 and container lid 20 for storing the letter tokens, game cards, and spinner.

Figure 2:
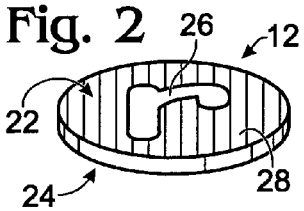
FIG. 2 is an isometric view of one of the letter tokens of FIG. 1, showing a first side of the letter token.

An exemplary letter token 12 is shown in greater detail in FIG. 2. Letter token 12 is shown as a flat and generally circular disk, but as explained below, any suitable shape may be used. Letter token 12 includes a first side 22 and a second side 24. First side 22 may include a letter indicator 26 that indicates a letter of the alphabet. For example, the letter indicator of the letter token of FIG. 2 is a lower-case "R," presented in a stylized font to resemble a shaped noodle in a bowl of alphabet soup. Referring again to FIG. 1, other letter tokens are shown to indicate other lower-case letters, each of which is shown to resemble shaped alphabet soup noodles.

However, although noodle-shaped lower-case letters are shown, some embodiments may include upper-case letters or a combination of lower- and upper-case letters, of any suitable alphabet, presented in any suitable manner and/or font. Further, some embodiments may repeat letters on more than one letter token and/or include more than one letter indicator on a letter token. The identities of the letters on the letter tokens, the incidence a given letter or letters appears, and the total number of letter tokens provided, may be varied, such as to provide a game based on a desired theme and/or a game pattern with a desired level of complexity or difficulty, as will be explained in greater detail below.

In addition to a letter indicator, first side 22 may further include distinguishable secondary recognition indicia 28, such as a color, that is associated with, or corresponds to, letter indicator 26. Such distinguishable secondary recognition indicia may assist younger players of the game to develop letter recognition and/or spelling skills, for example by providing letter identification information in addition to letter shape. As such, each letter or letter indicator may be provided with corresponding distinguishable secondary recognition indicia.

For example, the secondary recognition indicia of the letter token of FIG. 2 is shown as a red-colored background, against which the letter indicator is presented. Thus, in the illustrated embodiment, the color red is associated with the letter "R." Similarly, each other letter indicator of the illustrated embodiment is associated with a distinguishable color. With reference to FIG. 1, for example, the letter "O" can be seen to correspond with the color green, the letter "L" with blue, and so on. Each letter token of the illustrated embodiment thus presents a letter indicator against the correspondingly colored background.

However, although the distinguishable secondary recognition indicia is shown in the illustrated embodiment as a color, some embodiments may include distinguishable secondary recognition indicia such as a texture, a pattern, a shape, and so forth, instead of or in addition to a color, or any combination of such indicia.

Figure 3:
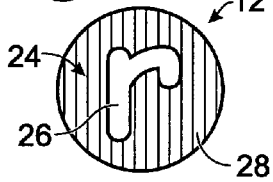
FIG. 3 is a top view of a second side of the letter token of FIG. 2 according to a first embodiment of a game of the present disclosure.

FIG. 3 shows second side 24 of letter token 12, which can be seen to include the same letter indicator (a lower-case "R") as included on first side 22. In addition, second side 24 includes the same secondary recognition indicia (a red background) as included on first side 22. Accordingly, each letter token 12 of the illustrated embodiment includes the same letter indicator and secondary recognition indicia combination on both sides.

However, in some embodiments, second side 24 of letter token 12 may be left blank, may include a different letter indicator and secondary recognition indicia combination than first side 22, or may be otherwise differently marked than first side 22. For example, in an alternate embodiment shown in FIG. 4, second side 24' of letter token 12 is illustrated. Second side 24' includes the same letter indicator (a lower-case "R") as included on first side 22, and also includes nondistinguishable secondary recognition indicia 28' (or no secondary recognition indicia), i.e., the letter indicator 26 on second side 24' is presented against a nondistinguishable or neutral-colored background. Similarly, the second side of each letter token of this alternate embodiment may include a letter indicator displayed against the same neutral-colored background.

As explained in more detail below, an embodiment of the game that includes letter tokens including a letter indicator with distinguishable secondary recognition indicia on one side, and a letter indicator with nondistinguishable secondary recognition indicia (or no secondary recognition indicia) on the opposite side, may present a greater challenge to players that are developing letter recognition skills. Such players may choose to use, or a set of rules may instruct use of, the side of the letter tokens including only letter indicators displayed against a nondistinguishable background, for example so that players rely solely on letter shape information in order to recognize a particular letter, without the benefit of distinguishable secondary recognition indicia.

The letter tokens may be adapted for play with game cards 14. An exemplary game card 14 is shown in greater detail in FIG. 5, in which game card 14 is shown as a flat and generally circular disk. Consistent with the "alphabet soup" theme as mentioned above, the game card may be marked to resemble a top view of a bowl of alphabet soup. Thus, the game cards may be larger than the letter tokens 12, although any suitable shape and/or size may be used. Game card 14 includes a first side 32 and a second side 34.

First side 32 may further include a word region 36 including a first plurality of letter spaces 38, each letter space including a letter indicator 26. As shown, the letter spaces in word region 36 are collectively arranged such that the letter indicators spell a word 40. For example, the spelled word on the exemplary game card (indicated as 40*a*) is "OWL."

Each letter space 38 may also include the secondary recognition indicia 28 associated with letter indicator 26. For example, each letter space 38 of the illustrated embodiment is shown to be colored to match the colored background of the letter token bearing the same letter indicator. Color correspondence between the letter tokens and the letter spaces, in addition to letter correspondence, may assist players in determining which letter tokens are necessary to complete the spelling of the words presented on the game cards. However some letter spaces 38 may not include distinguishable secondary recognition indicia 28, as explained in more detail below.

Each letter space 38 is also shown to be sized and shaped similarly to a letter token. For example, the exemplary game card is shown with a letter token 12 placed on the letter space that includes the letter "O." Thus, in the depicted embodiment, the letter spaces 38 correspond, in size, shape, color, and letter indicator, to the letter tokens that correspond to the letters of the spelled word 40. However, while such correspondence may assist players in recognizing the correct letter tokens to be placed on the letter spaces, other embodiments of the game cards may include letter spaces that are differently sized and/or shaped than the letter tokens.

First side 32 may further include an image region 42, which includes an image 44 or other graphical representation of the spelled word 40, for example to provide a contextual reference for a player attempting to read the spelled word. The exemplary game card includes the word "OWL," and thus the image is an illustration of an owl (indicated as 44*a*).

As mentioned above, embodiments of the game may include one or more features that may allow accommodation of players of different skill levels, and/or that may present a challenging aspect to players that are developing spelling or letter recognition skills. One such feature is described above with reference to the letter tokens, each of which may include a letter indicator against a correspondingly colored background on one side, and a letter indicator against a neutral background on the other side. Color correspondence (and/or other distinguishable secondary recognition indicia) may provide additional contextual information to assist players in identifying letters, and players developing letter recognition skills may find it easier to recognize a particular letter presented with the additional contextual information than presented without. Thus, providing letter tokens without additional contextual information on one side may allow players of developing and/or different skill levels to continue to be interested in, or challenged by, such a game.

Figure 6:
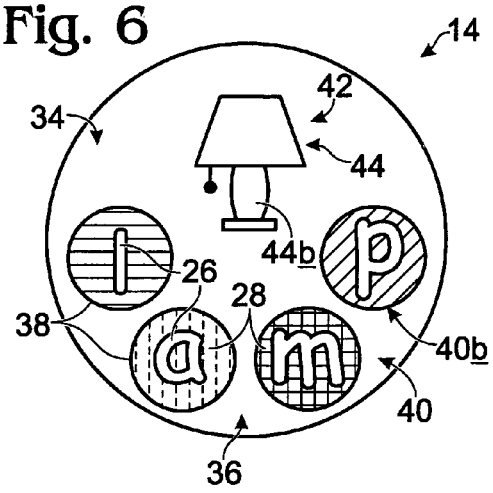
FIG. 6 is a top view of a second side of the game card of FIG. 5 according to a first embodiment of a game of the present disclosure.

Other game components may optionally be adapted to present a challenging aspect to players as they develop reading and/or spelling skills. For example, FIG. 6 shows second side 34 of exemplary game card 14. Like first side 32, second side 34 includes a word region 36 in which letter spaces 38 arranged such that letter indicators 26 spell a word 40, and an image region 42. However, second side 34 includes a different word 40 than that on first side 32, and a different image 44. Specifically, second side 34 includes the word "LAMP" (indicated as 40*b*) and an illustration of a lamp (indicated as 44*b*).

Figure 4:
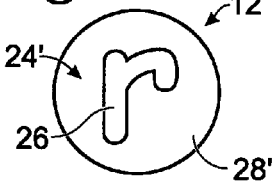
FIG. 4 is a top view of a second side of the letter token of FIG. 2 according to a second embodiment of a game of the present disclosure.
Figure 5:
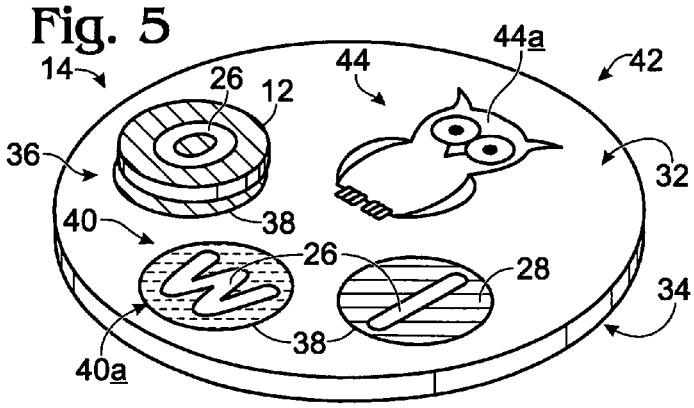
FIG. 5 is an isometric view of one of the game cards of FIG. 1, showing a first side of the game card and also showing a letter token positioned on one of the letter spaces of the game card.
Figure 7:
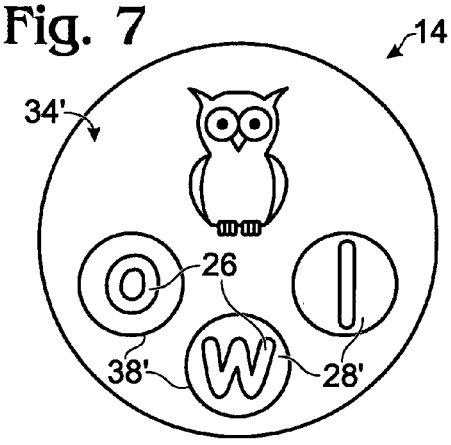
FIG. 7 is a top view of a second side of the game card of FIG. 5 according to a second embodiment of a game of the present disclosure.

In other embodiments, second side 34 of game card 14 may be otherwise differently marked than first side 32 to provide a challenging aspect as described above, such as by including a word of the same length but more difficult to spell, by including the same word but without distinguishable secondary recognition indicia, and so forth. For example, in an alternate embodiment shown in FIG. 7, second side 34' of game card 14 is illustrated. Second side 34' includes the same word ("OWL") and the same image (an illustration of an owl) as included on first side 32, but the letter spaces 38' include letter indicators presented against nondistinguishable secondary indicia (or no secondary indicia), i.e., the letter indicators 26 on second side 34' are each presented against the same nondistinguishable or neutral-colored background. The alternate embodiment of game cards 14, as shown in FIG. 7, may be suitable for use with the alternate embodiment of letter tokens 12, as shown in FIG. 4, in which a player may rely solely on letter shape information in order to recognize a particular letter, without the benefit of distinguishable secondary recognition indicia.

In still other embodiments, second side 34 of game card 14 may be left blank, may duplicate the first side of the game card, may include a different word of the same difficulty level as the word on the first side, and so forth.

Figure 8:
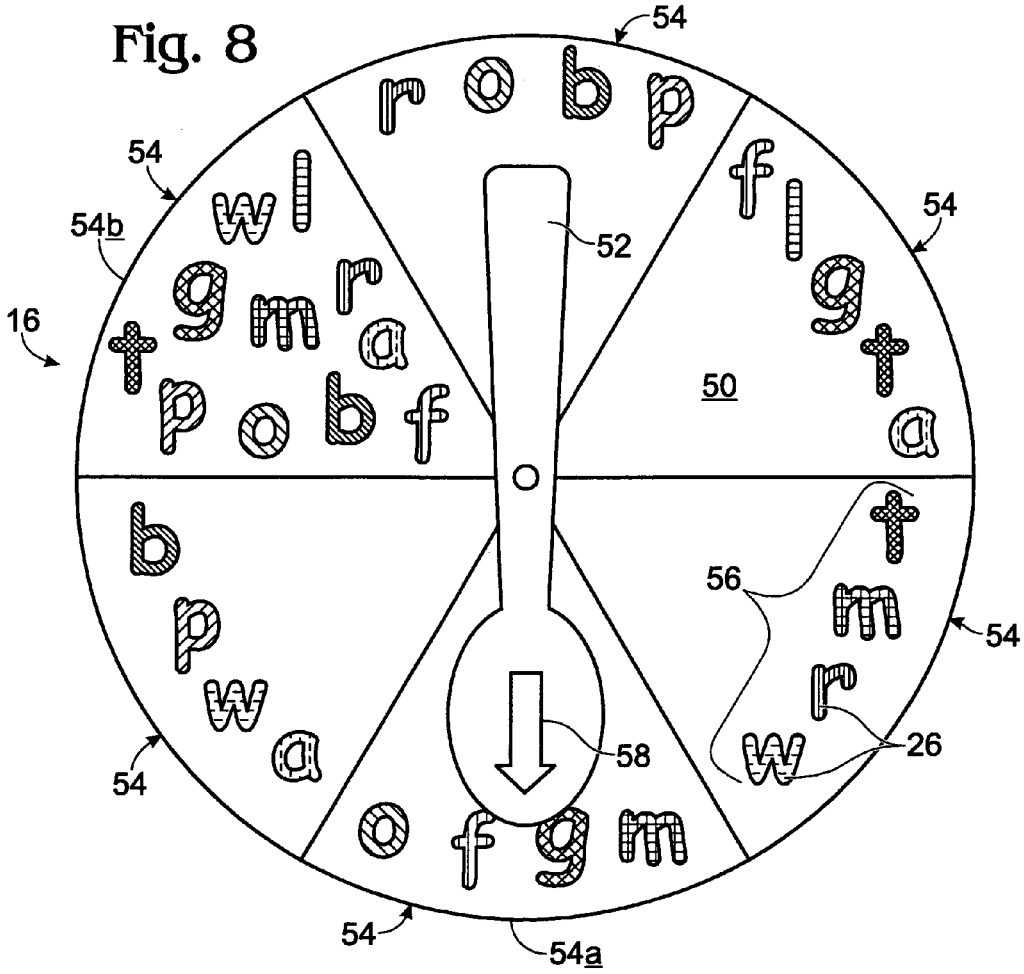
FIG. 8 is a top view of the spinner of FIG. 1.

Players may attempt to spell a word on a game card, for example by matching letter tokens to game cards by using a selection device such as spinner 16, an exemplary embodiment of which is shown in FIG. 8. Spinner 16 is shown as a flat and generally circular disk having a flat surface 50 and a pointer 52. Flat surface 50 is subdivided into a plurality of semicircular segments 54 of approximately equal size, each segment including a group 56 of letter indicators 26. Pointer 52, shown to include pointing indicia such as embossed arrow 58, is rotatably attached to flat surface 50 at the center of the circle formed by segments 54, such that pointer 52 is operable to randomly indicate a segment, or more particularly, the group of letter indicators in a segment, via arrow 58. For example, the arrow on pointer 52 in FIG. 8 indicates the segment (indicated as 54*a*) that includes the letters "O," "F," "G," and "M."

Consistent with the game components described above, each letter indicator 26 on the spinner may include distinguishable secondary recognition indicia. For example, in FIG. 8, each letter indicator is colored according to the color correspondence that appears on the illustrated letter tokens and game cards of the exemplary embodiment. However, in some embodiments, the letter indicators on the spinner may be presented against a colored background, or the spinner may contain nondistinguishable secondary recognition indicia (or no secondary recognition indicia), as desired.

Although other configurations of game components are possible, the illustrated embodiment of the game includes four game cards 14. As described above, each game card includes a three-letter word (such as "OWL," "BAT," "LOG," or "MAP") on a first side 32 and a four-letter word (such as "FROG," "BOWL," "BOAT," or "LAMP") on a second side 34. These eight words include a total of eleven different letters, each of which is represented as a letter indicator 26 on one or more letter tokens 14, and is also represented in one or more of the groups 56 of letter indicators 26 on spinner 16. One segment, a "wildcard" segment (indicated as 54*b*), contains all eleven letters used in the illustrated embodiment.

As explained in more detail below, spinner 16 may be used to indicate a group of letter indicators from which a player may choose a corresponding letter token, to attempt to spell a word on a game card. However, although a spinner is discussed and illustrated, any suitable selection device (including one or more dice, cards, and so forth) may be used.

Methods of game play utilizing the concepts and components discussed above may include use of the game as an instructional aid for teaching young children to spell words and/or to recognize letters. In some methods, game play may consist of turns or rounds, each round including: operating the selection device to indicate a group of two or more letter indicators; determining if a selected game card includes one or more letter indicators in the indicated group; if the selected game card includes one or more letter indicators in the indicated group, choosing a letter token that has a letter indicator included in both the indicated group and the selected game card; and placing the chosen letter token on the letter space including the letter indicator on the chosen letter token.

For example, according to one exemplary method of play using the game components of the exemplary embodiment, each player selects a game card and decides whether to spell the three-letter word or the four-letter word on the game card. (In the alternate embodiment described with reference to FIGS. 4 and 7, the players may decide whether to use the "colored" sides of the letter tokens and game cards or the neutrally-colored sides.) The object of this exemplary method of game play is to spell the word by matching each letter space on the game card with a letter token bearing the same letter indicator. Each player spins the spinner in turn, and is allowed to choose one letter from the segment designated by the pointer to match one of the spaces on the game card. If the "wildcard" segment (the segment including the group of all letter indicators) is indicated, the player may choose from any of the available letter tokens. Play continues until each player completes spelling the word on that player's game card.

Optionally, a game backstory or theme may provide a contextual framework or setting, according to which the game may be played, and/or which may be manifested in one or more game components or attributes, such as to aid player comprehension of the rules, to enhance entertainment value, and so forth. For example, as mentioned above, the game according to the exemplary embodiment is based generally upon the theme of alphabet soup, and the exemplary game components further this theme. Game container 18 is shaped, and may further be labeled, to resemble a can of soup. Each game card 14 resembles a top view of a bowl of alphabet soup, and may be marked with additional indicia to further this resemblance. Pointer 52 of spinner 16 is shaped like a soup spoon. Letter indicators 26 are depicted in a stylized font and are shaped to resemble alphabet soup noodles.

The following is an example of instructions and rules that might be used for the game according to the exemplary embodiment and based on the exemplary theme of alphabet soup.

Object:

Be the first to fill your bowl by matching the alphabet noodle tokens.

Set Up:

Decide which level of play is most comfortable for the each player.

Level 1—Use the 3-letter word side of the soup bowls.

Level 2—Use the more challenging 4-letter word side of the bowls.

Once everyone has decided which level of play is best, each player chooses a soup bowl. Play either the 3-letter side or the 4-letter side.

Spread out the alphabet noodle tokens in the middle of the playing area.

Place the spinner near the alphabet noodle tokens.

Let'S Play:

The youngest player goes first; spin the spinner. Give the spoon a good flick and see what letters you can scoop up! Where is the arrow at the end of the spoon pointing?

If the spoon is pointing to a space that includes a letter you need to fill your bowl, you may choose one of the alphabet noodle tokens and match it to your word. Match both the letter and the color!

If the spoon points to a space with all the letters showing, you may choose any one alphabet noodle token and match it to a letter in your bowl.

If the spoon points to a space that has none of the letters you need, your turn ends.

After you spin once, it's the next player's turn. Play passes to the left until a player fills his/her bowl by matching all the alphabet noodle tokens.

Winning:

The first player to fill his/her bowl wins! Continue playing to see who comes in second, third and fourth.

Although these specific game component configurations are illustrated, numerous variations are possible, either for a game based on an alphabet soup theme, upon another theme, or upon no theme.

It is believed that the disclosure set forth herein encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element of the equivalent thereof, such claims should be understood to include incorporation of one or more such elements, neither requiring nor excluding two or more such elements.

It is believed that the following claims particularly point out certain combinations and subcombinations of features, functions, elements and/or properties that may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. A game for at least one player, comprising:

at least one game card, each game card including a first side and a second side, the first side including a plurality of letter indicators each letter indicator having only one letter and the plurality of letter indicators on the at least one game card are arranged to spell a word on the at least one game card and the at least one game card having a graphical representation of the corresponding spelled word, each letter indicator on the at least one game card including distinguishable secondary recognition indicia, the secondary recognition indicia are identical on all letter indicators having the same letter, while the secondary recognition indicia are different on the letter indicators having different letters such that the secondary recognition indicia uniquely corresponding to the letter indicated;

a plurality of letter tokens, each letter token including a letter indicator; and a selection device including a plurality of groups of letter indicators, each group having two or more different letter indicators and the selection device operable to randomly and exclusively indicate only one of the groups.

2. The game of claim 1 wherein secondary recognition indicia includes a color.

3. The game of claim 1 wherein the second side of each game card also includes a plurality of letter indicators arranged to spell a word.

4. The game of claim 3 wherein the spelled word on the first side of each card is different from the spelled word on the second side.

5. The game of claim 4 wherein the plurality of letter indicators of the first side of each card is different from the plurality of letter indicators on the second side.

6. The game of claim 4 wherein the plurality of letter indicators of the first side of each card is equal to the plurality of letter indicators on the second side.

7. The game of claim 3 wherein the spelled word on the first side of each card is the same as the spelled word on the second side; and wherein each letter indicator on the second side includes nondistinguishable secondary recognition indicia.

8. The game of claim 7 wherein secondary recognition indicia includes a color.

9. The game of claim 1, wherein each letter token includes a first side and a second side;

wherein the first side includes the same letter indicator as the second side;

wherein each letter indicator on the first side includes distinguishable secondary recognition indicia uniquely corresponding to the letter indicated; and wherein each letter indicator on the second side includes nondistinguishable secondary recognition indicia.

10. The game of claim 1 wherein each letter token includes a first side and a second side, and wherein the first side includes the same letter indicator as the second side.

11. The game of claim 1 wherein the selection device includes:

a flat surface upon which the plurality of groups of one or more letter indicators are marked; and a pointing mechanism rotatably mounted to the flat surface and configured to randomly indicate a group when rotated.

12. The game of claim 1, further comprising a set of rules to play the game.

13. The game of claim 12 wherein the set of rules provides that a round of game play includes:

operating the selection device to indicate a group of one or more letter indicators;

determining if a selected game card includes one or more letter indicators in the indicated group;

choosing a letter token that has a letter indicator included in both the indicated group and the selected game card; and placing the chosen letter token on the letter space including the letter indicator on the chosen letter token.

14. The game of claim 13 wherein the set of rules further provides that a goal of the game is to play successive rounds until letter tokens have been placed on all of the letter indicators on a selected game card.

15. The game of claim 13 wherein the set of rules further provides that, prior to game play, a game card is selected for each player to the game.

* * * * *